US011562866B2

(12) United States Patent
Jeong

(10) Patent No.: US 11,562,866 B2
(45) Date of Patent: Jan. 24, 2023

(54) MULTI-DIRECTIONAL SWITCH

(71) Applicants: Hyundai Motor Company, Seoul (KR); Kia Motors Corporation, Seoul (KR)

(72) Inventor: Min-Gun Jeong, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 288 days.

(21) Appl. No.: 16/861,717

(22) Filed: Apr. 29, 2020

(65) Prior Publication Data

US 2021/0193414 A1 Jun. 24, 2021

(30) Foreign Application Priority Data

Dec. 19, 2019 (KR) ..... 10-2019-0170574

(51) Int. Cl.
*H01H 1/58* (2006.01)
*H01H 25/04* (2006.01)

(52) U.S. Cl.
CPC ..... *H01H 25/041* (2013.01); *H01H 1/58* (2013.01); *H01H 2001/5894* (2013.01)

(58) Field of Classification Search
USPC ..... 335/106
See application file for complete search history.

(56) References Cited

U.S. PATENT DOCUMENTS 6,329,622 B1 * 12/2001 Ando ..... H01H 25/041 200/537
6,794,589 B2 * 9/2004 Kubat ..... H01H 25/041 200/6 A

FOREIGN PATENT DOCUMENTS

JP 2000315445 A 11/2000
JP 2010040431 A 2/2010
KR 2017-0069534 A 6/2017

* cited by examiner

*Primary Examiner* — Toan T Vu
*Assistant Examiner* — Xuan Ly
(74) *Attorney, Agent, or Firm* — Fox Rothschild LLP

(57) ABSTRACT

A multi-directional switch is provided to include a spring electrode supported by a base housing and having a plate shape divided in multiple directions. A fastening bolt is fastened to the base housing through penetrating the spring electrode and has an upper surface on which a curved surface is formed. A P-type switch is supported by the curved surface of the fastening bolt and includes a push part configured to press the spring electrode.

6 Claims, 6 Drawing Sheets

MULTI-DIRECTIONAL SWITCH

CROSS-REFERENCE TO RELATED APPLICATION

This application claims priority to Korean Patent Application No. 10-2019-0170574, filed on Dec. 19, 2019, which is incorporated herein by reference in its entirety.

BACKGROUND

Field of the Disclosure

The present disclosure relates to a switch, and more particularly, to a multi-directional switch, which may be switched in multiple directions and supply mass power.

Description of the Related Art

A switch is a component that supplies a power to a load, such as a lamp or a motor within a vehicle, to operate the load. To operate a device, a sufficient power should be supplied thereto. Although it is preferable that the switch is directly connected to the load, most switches are unable to supply sufficient power to drive the load. Accordingly, only a low power for connecting a relay is supplied through the switch, and actual load connection is performed through a relay or a power element.

Direct power driving may be adopted, but in this case, the design of the switch for safety of power transfer is restricted. A direct drive type switch is classified into two types. For a sliding type direct drive switch, a power is transferred through a sliding contact of a plate material, but grease is used as an interface material causing the switch to be vulnerable to interface carbonization and corrosion.

For a butt type contact, it is required for the contact to come in contact at high speed and to maintain the contact state, and thus it is difficult to select a suitable shape of the contact. Accordingly, switches having specific structures have been developed. A tactile switch disclosed in the related art is unable to supply a sufficient power, and other developed techniques are able to supply power, but include causes of inferiority.

In other words, when using the tactile switch, it is not possible to supply mass power due to its structural vulnerability, and it is not possible to design a dome structure having sufficient conductivity. Further, a P-type switch has a complex structure, and thus mass production thereof is not possible. In addition, the P-type switch has a vulnerable contact part, and thus it causes a problem in durability in the case of supplying mass power.

As an example, the existing separated type four-way switch as shown in FIG. 1 of the related art has a complex structure for the four-way driving. In other words, a bar 1 that stands in a vertical direction is separated into two pieces for 4-axis movement to be operated by a hinge. Further, a separate structure 2 for pushing the switch is inserted in the middle, and P-type switches are respectively located at four corners.

In particular, the switch includes three separate components and 12 electrical circuits in total to form an electrode. Further, since an electrical conduction route forming the switch is maintained only by a force for pushing a P-type spring, there is a high possibility that conduction inferiority occurs due to wear and corrosion, and thus an additional plating process is required.

The foregoing description of the background technology is intended merely to help the understanding of the background of the present disclosure, and is not intended to mean that the present disclosure falls within the purview of the related art that is already known to those of ordinary skill in the art.

SUMMARY

Exemplary embodiments of the present disclosure overcome the above disadvantages and other disadvantages not described above, and an object of the present disclosure is to provide a multi-directional switch, which supplies mass power in contrast with the existing switch structure, easily copes with automation and mass production through simplifying of a structure thereof, and has a low possibility that inferiority and duration problems occur through an improved contact with an electrode part for the power supply by fastening.

Other objects and advantages of the present disclosure may be understood by the following description, and become apparent with reference to the exemplary embodiments of the present disclosure. Also, it is obvious to those skilled in the art to which the present disclosure pertains that the objects and advantages of the present disclosure may be realized by the means as claimed and combinations thereof.

In one aspect of the present disclosure, a multi-directional switch may include a spring electrode supported by a base housing and having a plate shape divided in multiple directions; a fastening bolt fastened to the base housing through penetrating the spring electrode and having an upper surface on which a curved surface is formed; and a P-type switch supported by the curved surface of the fastening bolt and including a push part capable of pressing the spring electrode.

The P-type switch includes an upper plate and the push part extends downward from a side end of the upper plate. A fastening part having a curved surface may be seated on the curved surface of the fastening bolt. An engaging end projecting from a side surface may be formed on the push part. The push part may be formed to be divided as many as the number of divisions of the spring electrode. The curved surface of the fastening bolt may be formed as a concave surface, and the curved surface of the fastening part may be formed as a convex surface that is convex downward.

Additionally, the curved surface of the fastening bolt may be formed as a convex surface, and the curved surface of the fastening part may be formed as a concave surface that is concave downward. The fastening bolt may be fastened to a bus bar. The multi-directional switch may further include a solenoid having a contact deployed at each divided end portion of the spring electrode and a magnetic body attached to the contact, and disposed within the base housing.

In another aspect of the present disclosure, a multi-directional switch may include a spring electrode supported by a base housing and having a plate shape divided in multiple directions and a fastening bolt fastened to the base housing through penetrating the spring electrode. A P-type switch may be supported by the fastening bolt and may include a push part capable of pressing the spring electrode, wherein the fastening bolt may be fastened to a bus bar.

The push part may be formed to be divided as many as the number of divisions of the spring electrode. The existing switch is limited to cause the mass power flow, whereas according to the present disclosure, the mass power circuit may be configured with a simplified structure. According to the existing switch, it is not possible to construct the mass power circuit, and thus it is required to additionally install a relay to secure durability and performance.

Further, according to the existing switch, a complex structure and a large number of components are required to configure the four-way shape, whereas according to the structure according to the present disclosure, the number of components may be reduced, and durability and reliability may be further improved. Additionally, according to the existing switch, the contact type driving part is continuously worn out thus causing the conduction inferiority, whereas according to the present disclosure, no part is worn out, and thus the durability and reliability may be improved.

According to the existing switch, the shape and the number of contacts are limited, whereas according to the present disclosure, there is no limit in the shape and the number of contacts. In other words, it is possible to manufacture the switch in various shapes, such as 3, 4, 6, and 8 contacts, and by folding the horizontal plate in a vertical direction, the switch may be driven in the vertical direction. Further, according to the existing switch, a lever located on an upper portion in four ways is required to be operated to drive the switch, and thus the switch has a complex hinge structure, whereas according to the present disclosure, the upper structure operates as a movable support by changing the shape of the bolt, and thus the switch may operate in various directions, such as in four directions or in six directions.

In addition, according to the existing switch, the vertically shaped contacts and long lever (e.g., about 2 cm or more) for operating the contacts are required, whereas according to the technology according to the present disclosure, it may be possible to configure the switch having a height level of about 0.5 cm. Further, the structure according to the present disclosure may be driven by a mechanical operation and also using a solenoid, and thus the multi-channel relay may be manufactured.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The above-described objects, features, and advantages of the present disclosure will be described in detail with reference to the accompanying drawings, and accordingly, those of ordinary skill in the art to which the present disclosure pertains will be able to fully understand and easily embody the technical concept of the present disclosure. In describing the preferred embodiments of the present disclosure, detailed description of well-known technologies related to the present disclosure will be reduced or omitted in the case where it is determined that it obscures the subject matter of the present disclosure in unnecessary detail.

Figure 1:
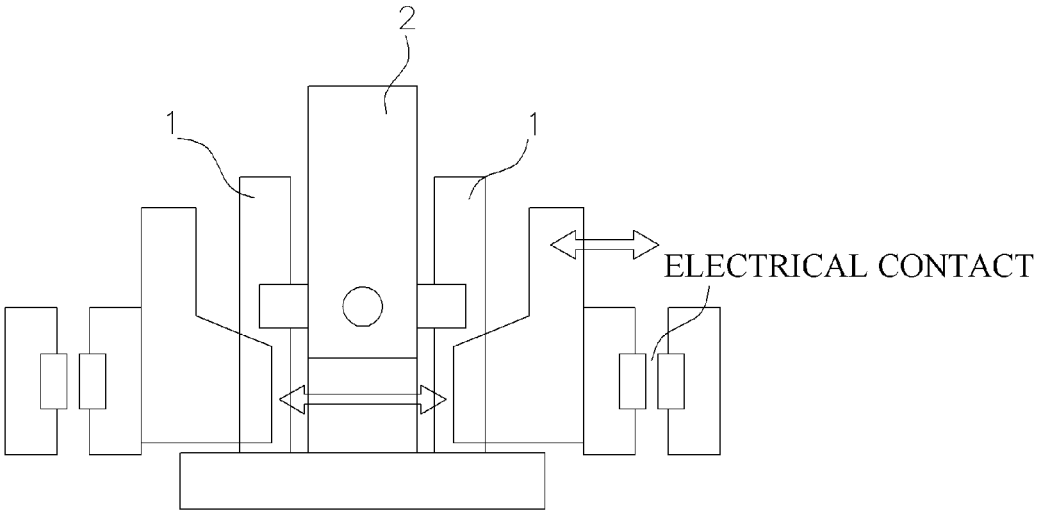
FIG.1 RELATED ART
FIG. 1 is a diagram schematically illustrating a four-way switch in the related art.
Figure 2:
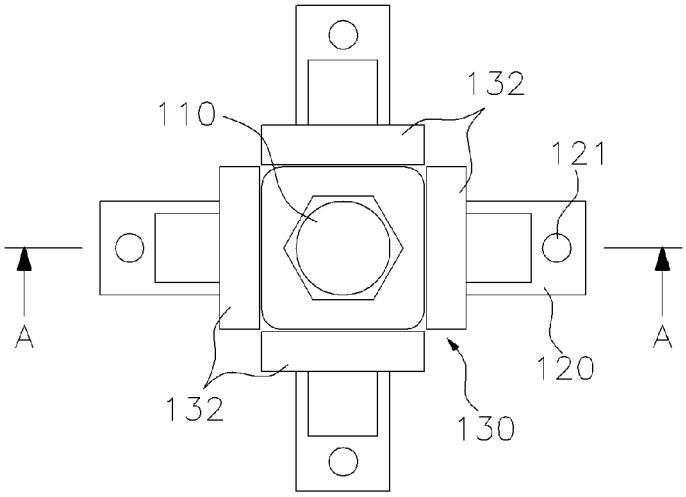
FIG. 2 is a diagram illustrating a planar shape of a multi-directional switch according to an exemplary embodiment of the present disclosure.
Figure 3:
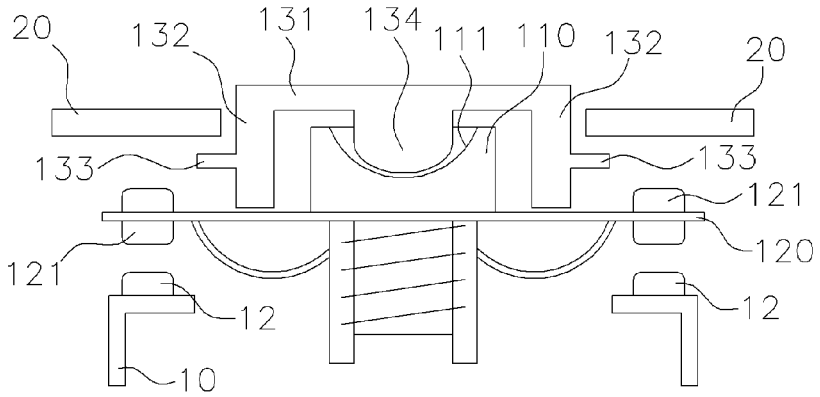
FIG. 3 is a diagram illustrating a cross-sectional shape taken along line A-A of FIG. 2 according to an exemplary embodiment of the present disclosure.
Figure 4:
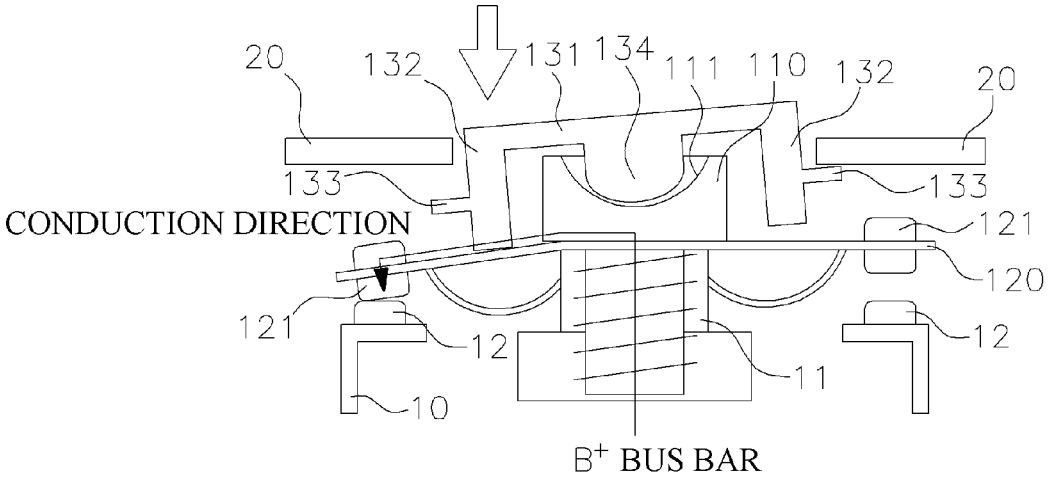
FIG. 4 is a diagram illustrating an operation state of a multi-directional switch according to the present disclosure based on FIG. 3 according to an exemplary embodiment of the present disclosure.

FIG. 2 is a diagram illustrating a planar shape of a multi-directional switch according to the present disclosure, FIG. 3 is a diagram illustrating a cross-sectional shape taken along line A-A of FIG. 2, and FIG. 4 is a diagram illustrating an operation state of a multi-directional switch according to the present disclosure based on FIG. 3. Hereinafter, with reference to FIGS. 2, 3, and 4, a multi-directional switch according to an exemplary embodiment of the present disclosure will be described.

The present disclosure relates to a seat switch for a vehicle or a switch used in a similar device. Through an operation of the switch according to the present disclosure, a motor disposed inside a seat may operate to move a location of the seat or to move a seat back or a lumbar support to a desired location. However, the existing seesaw type direct drive switch is only capable of operating in two directions, and is unable to operate in four directions. Even in the case of the operation in the two directions, a complex switch structure is necessary. For four-directional operation, four tactile switches and four relays should be used, and in this case, the cost is increased due to the addition of the relays. Even in the case of a mechanical direct drive switch to cope with this, a P-type spring switch is deployed in four directions causing limitations in shape, and the manufacturing process is complex thus causing disadvantage in automation.

In contrast, a multi-directional switch according to the present disclosure has an elastic restoring force, and may include a spring electrode 120 having a plate shape divided in multiple directions, a fastening bolt 110 fixing the spring electrode 120, and a P-type switch 130 deployed on an upper side of the fastening bolt 110 and capable of pressing the spring electrode 120. The spring electrode 120 may be deployed to be supported on an electrode support part 11 formed on a base housing 10, and as illustrated, a plurality of contacts 12, in the drawing, four-directional contacts 12, may be deployed on the base housing 10, and four contacts 121 at each end portion of the spring electrode 120 that is divided in four directions may be engaged with each other to be conductive.

The fastening bolt 110 may be fastened to the base housing 10 through penetrating the spring electrode 120 to fix the spring electrode 120 on the electrode support 11. Further, the upper surface of the fastening bolt 110 may be formed as a rounded curved surface. As exemplified in the drawing, the upper surface of the fastening bolt 110 may be formed as a concave surface. Further, the P-type switch 130 deployed on an upper side of the fastening bolt 110 may include an upper plate 131, a push part 132, and a fastening part 134.

The upper plate 131 may be substantially flat, and as illustrated, the upper plate 131 may be deployed in a space formed between the upper housings 20 to be operable. The push part 132 may extend downward from a side end of the upper plate 131, and as illustrated, for the four-way switch, four push parts 132 may be formed. The fastening part 134 may support the P-type switch 130 on the fastening bolt 110, and as exemplified above, when the upper surface 111 of the fastening bolt 110 is a concave surface, the fastening part 134 may be formed to be convex downward and seated on the concave surface of the fastening bolt 110.

According to the present disclosure, the P-type switches may be manufactured in the form of two switches per axis or in the form of four cross-shaped switches to fix the center part through bolt fastening. The fastening bolt 110 may be fastened to the bus bar, and may serve as a B+ power supply circuit as shown in FIG. 4 to allow high-load connection.

As illustrated, when the upper plate 131 is pushed in one of four directions, the push part 132 presses the spring electrode 120, and the corresponding contact 121 of the spring electrode 120 comes in contact with the contact of the base housing 10 to be conductive to supply the power to the load. Further, an engaging end 133 formed to project from a side surface of the push part 132 may be engaged with the upper housing 20 to prevent excessive deformation, and when the pressing force is released, the spring electrode 120 may be restored to an original location by the elastic restoring force.

Figure 5:
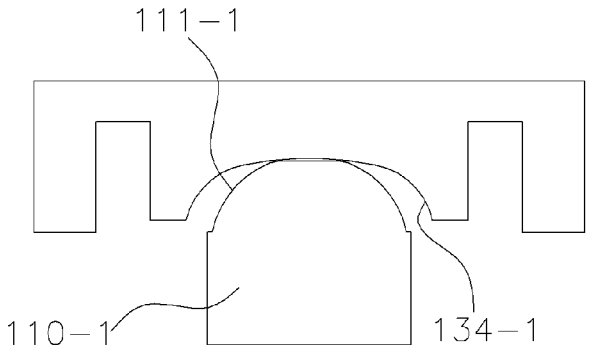
FIG. 5 is a diagram illustrating a part of a multi-directional switch according to another exemplary embodiment of the present disclosure.

As shown in FIG. 5, the upper surface 11-1 of the fastening bolt 110-1 may be formed as a convex surface, and the fastening part 134-1 of the P-type switch 130 may be formed as a concave surface that is concave downward to be engaged with each other, and through such a configuration, the multi-directional push may be freely implemented. Meanwhile, the spring electrode 120 according to the present disclosure may be manufactured in a punching method through pressing, and thus may be implemented in various shapes.

Figure 6A:
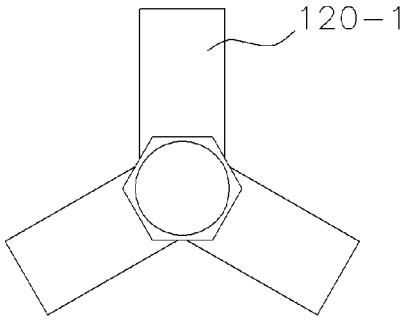
FIGS. 6A to 6D are diagrams illustrating an application example of a multi-directional switch according to an exemplary embodiment of the present disclosure.
Figure 6B:
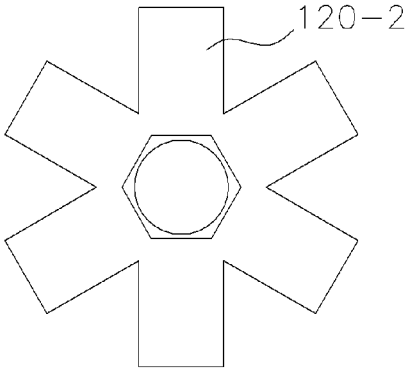
Figure 6C:
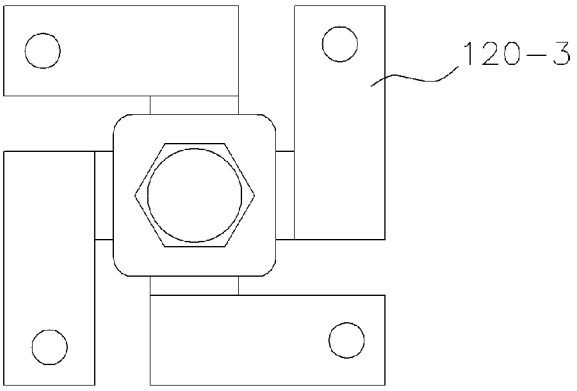
Figure 6D:
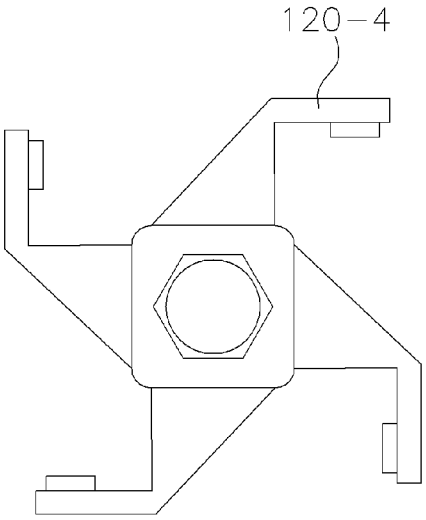

In other words, the spring electrode 120 may be implemented as a spring electrode 120-1 divided in three directions as shown in FIG. 6A, a spring electrode 120-2 divided in six directions as shown in FIG. 6B, a spring electrode 120-3 in the shape of 卐 as shown in FIG. 6C, and in the shape of 卍 slantingly folded as shown in FIG. 6D. In particular, the 卍 shape may be described as a cross, the arms of which are of equal length and perpendicular to the adjacent arms, each bent midway at a right angle. Further, the spring electrode 120 may be implemented in the form of a circle, and it may be configured in various shapes, such as 3, 6, and 8 contacts.

Figure 7A:
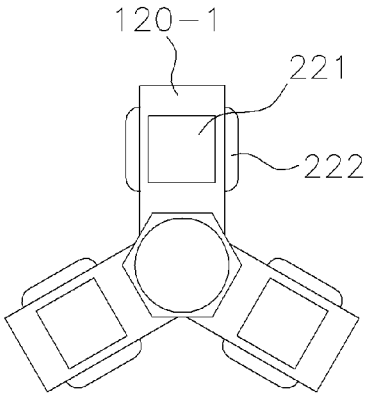
FIGS. 7A and 7B are diagrams illustrating another application example of a multi-directional switch according to an exemplary embodiment of the present disclosure.
Figure 7B:
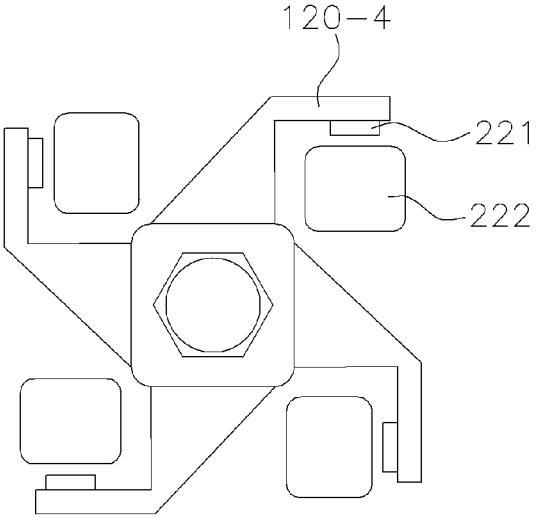

Further, as illustrated in FIGS. 7A and 7B, a magnetic body 221 may be attached to a bottom of a contact 121 of the spring electrode 120. In particular, the spring electrodes 120-1 and 120-4 may be driven by a solenoid 222 disposed on the housing adjacent to the magnetic body 221, to thus manufacture the multi-channel relay. In other words, it may be a magnetic material, and a ferromagnetic material is more preferable.

As described above, the multi-directional switch according to the present disclosure may supply mass power without possibility of wear and corrosion, and thus may secure sufficient durability and performance even if only specifications of non-plating or inexpensive tin plating are applied. Further, since the mount in the vertical direction is possible, the multi-directional switch has advantageous characteristics for automation of the manufacturing process, and cost saving becomes possible through process simplification, component number reduction, plating process deletion, and thickness reduction.

While the present disclosure has been described with reference to the exemplified drawings, it will be apparent to those of ordinary skill in the art that the present disclosure is not limited to the described exemplary embodiments, and various changes and modifications may be made without departing from the spirit and scope of the present disclosure. Accordingly, such changes and modifications should belong to the claims of the present disclosure, and the right of the present disclosure should be construed based on the appended claims.

What is claimed is:

1. A multi-directional switch, comprising:

a spring electrode supported by a base housing and having a plate shape divided in multiple directions;

a fastening bolt fastened to the base housing through penetrating the spring electrode and having an upper surface on which a curved surface is formed;

a P-type switch supported by the curved surface of the fastening bolt and including a push part configured to press the spring electrode, wherein the P-type switch includes:

an upper plate;

the push part extending downward from a side end of the upper plate; and a fastening part having a curved surface seated on the curved surface of the fastening bolt;

a solenoid having a contact deployed at each divided end portion of the spring electrode; and a magnetic body attached to the contact and disposed in the base housing.

2. The multi-directional switch of claim 1, wherein an engaging end that projects from a side surface is formed on the push part.

3. The multi-directional switch of claim 1, wherein the push part is formed to be divided into as many sections as the number of divisions of the spring electrode.

4. The multi-directional switch of claim 1, wherein the curved surface of the fastening bolt is formed as a concave surface, and the curved surface of the fastening part is formed as a convex surface that is convex downward.

5. The multi-directional switch of claim 1, wherein the curved surface of the fastening bolt is formed as a convex surface, and the curved surface of the fastening part is formed as a concave surface that is concave downward.

6. The multi-directional switch of claim 1, wherein the fastening bolt is fastened to a bus bar.

* * * * *